United States Patent [19]

Prough

[11] Patent Number: 4,946,556

[45] Date of Patent: Aug. 7, 1990

[54] METHOD OF OXYGEN DELIGNIFYING WOOD PULP WITH BETWEEN STAGE WASHING

[75] Inventor: J. Robert Prough, Glens Falls, N.Y.

[73] Assignee: Kamyr, Inc., Glens Falls, N.Y.

[21] Appl. No.: 342,937

[22] Filed: Apr. 25, 1989

[51] Int. Cl.[5] ..... D21C 1/04; D21C 9/02; D21C 9/147

[52] U.S. Cl. ..... 162/60; 162/65; 162/76

[58] Field of Search ..... 162/88, 89, 65, 60, 162/19, 76

[56] References Cited

U.S. PATENT DOCUMENTS

| | | | |
|---|---|---|---|
| 4,050,981 | 9/1977 | Jamieson | 162/60 |
| 4,295,927 | 10/1981 | Bentvelzen et al. | 162/65 |
| 4,798,652 | 1/1989 | Joyce | 162/60 |
| 4,806,203 | 2/1989 | Elton | 162/65 |

OTHER PUBLICATIONS

Enz et al., "Oxidative Extration: An Opportunity for Splitting the Bleach Plant"; *TAPPI*, Jun. 1984; pp. 54–57.

Tomiak et al., "Countercurrent Pulp Washing Theory: An Attempt at a Synthesis", *TAPPI*, vol. 60, No. 9, Sep. 1977, pp. 148–150.

Pulp & Paper Canada, vol. 81, No. 2, Feb., 1980, pp. 68 through 71, Histed "How to Avoid Viscosity Loss During Chlorination".

*Primary Examiner*—Steve Alvo

*Attorney, Agent, or Firm*—Nixon & Vanderhye

[57] ABSTRACT

The viscosity of paper pulp is maximized, while chlorine bleaching is minimized or eliminated, by subjecting the pulp suspension to multiple consecutive oxygen bleaching stages, with a countercurrent wash between $O_2$ stages. A chelating agent—such as EDTA—may be added to the countercurrent wash liquid, and/or another chelating agent—such as DTPA—may be used to pretreat the pulp.

20 Claims, 1 Drawing Sheet

METHOD OF OXYGEN DELIGNIFYING WOOD PULP WITH BETWEEN STAGE WASHING

BACKGROUND AND SUMMARY OF THE INVENTION

There is intense interest in the pulp and paper art for the reduction of the amount of chlorine used in bleaching pulp. Chlorine has been shown in many situations to generate poisonous compounds, such as dioxins, in the bleach plant effluent.

A number of steps have been taken to try and minimize the amount of chlorine utilized for bleaching. Some approaches utilize oxygen pre-treatment, and high chlorine dioxide use. Such procedures are not entirely effective, however, because there are limitations in the final brightness that can be achieved, and because chlorine dioxide is a much more expensive bleaching chemical and significantly increases bleaching chemical and significantly increases bleaching costs. To overcome the final brightness limitations, peroxide is sometimes used. However peroxide is also very expensive. A typical old sequence, and a new sequence in which chlorine use is minimized, are $C_E$EDED, and $OC_DE_O$DEDP, respectively, wherein O is oxygen treatment, D chlorine dioxide, C chlorine, P peroxide, and E caustic extraction.

Another way in which chlorine usage can be minimized is to use more oxygen—for example a stronger $E_O$ stage. Unfortunately this causes strength (viscosity) losses. However, according to the present invention it has been found that the viscosity loss caused by utilizing more oxygen can be overcome by providing a series of oxygen stages with washing between the stages. It has also been found that while chlorine can be used as the first stage to affect acid removal of metals, pre-treatment of the pulp with a chelating agent, such as DTPA, and/or adding another chelating agent, such as EDTA, and the oxygen reactor, also allows one to achieve better bleaching (a lower Kappa number) without undue loss of viscosity or yield. The lower pH's caused by the oxygen stage combined with the chelating removes metals, which allows operation of the process to lower Kappa numbers.

According to the present invention it is possible to minimize or eliminate chlorine usage in bleaching by utilizing a two (or more) stage oxygen treatment process with washing between the stages and with the first stage operated to control pH between the stages, and with the chelating agent utilized for pre-treatment and/or added to the counter-flow of wash liquid in the wash between the oxygen stages. The gains in brightness, without subsequent viscosity loss, by utilizing the between stage washing are dramatic, being substantially equal to such gains as can be obtained utilizing pre-treatment with DTPA.

According to one aspect of the present invention there is provided a method of bleaching paper pulp comprising the steps of: (a) Effecting oxygen bleaching of the pulp in at least two consecutive stages; and (b) Effecting washing of the pulp between each of said at least two consecutive stages to maximize viscosity for a given degree of bleaching. It is also desirable to practice the step (c), before step (a), of pre-treating the pulp with a chelating agent such as DTPA, and to provide the further step (d), during the practice of step (b), of simultaneously treating the pulp with a chelating agent such as EDTA. For example the EDTA may be added to a countercurrent flow of wash liquid to the pulp in the between stage washing. Exactly two oxygen stages may be utilized, or a number of different oxygen stages. Step (a) is practiced to control the pH between stages so that it is at an acidic level conducive to effective EDTA chelating.

According to another aspect of the present invention a high viscosity bleached paper pulp is produced by practicing the steps of: (a) Effecting oxygen bleaching of the pulp in at least two consecutive stages; and (b) Effecting washing of the pulp between each of said at least two consecutive stages to maximize viscosity for a given degree of bleaching.

The invention also contemplates a method of delignifying a suspension of comminuted cellulosic fibrous material (pulp) at a consistency of about 6–15% comprising the steps of sequentially and continuously: (a) Subjecting the suspensions, while at a consistency of about 6–15%, to a first oxygen delignification treatment. (b) Washing the suspension, while at a consistency of about 6–15%. And, (c) subjecting the suspension, while at a consistency of about 6–15%, to a second oxygen delignification treatment. Step (b) is practiced by a countercurrent flow of wash liquid, and during the practice of step (b) a chelating agent is preferably added to the wash liquid. Prior to step (a) there preferably is also a step of pre-treating the suspension with a chelating agent.

It is the primary object of the present invention to provide a method for bleaching paper pulp or the like in which the amount of chlorine usage is minimized, or chlorine is eliminated entirely, while the viscosity of the paper pulp is maximized and an adequate degree of bleaching (low Kappa number) is achieved.

DETAILED DESCRIPTION OF THE DRAWINGS

Figure 1:
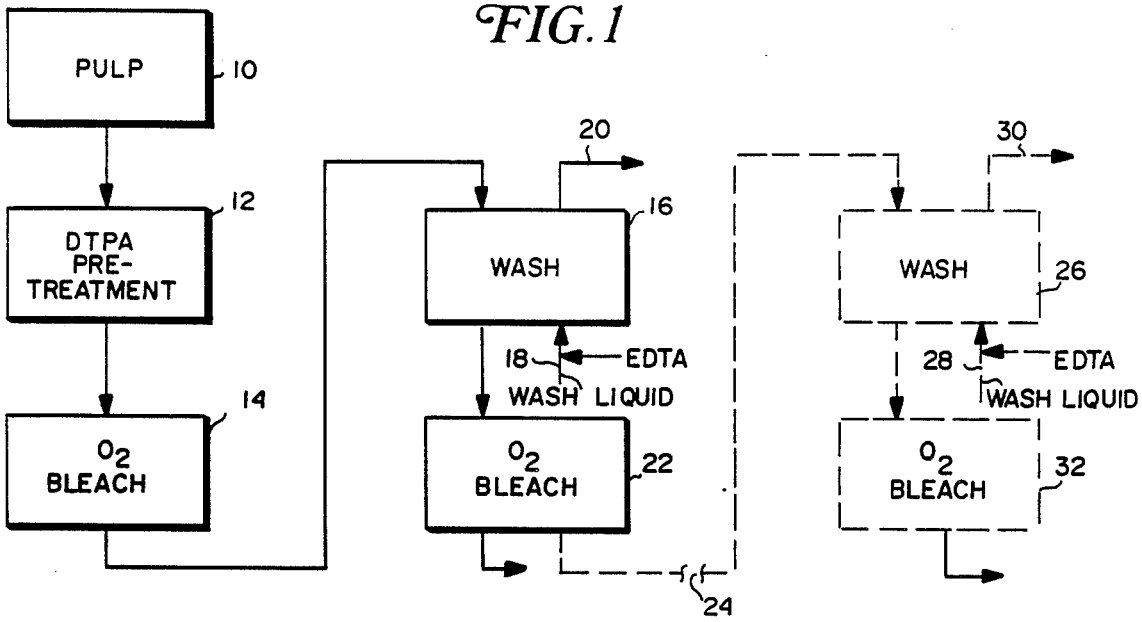
FIG. 1 is a schematic illustration of the exemplary method steps that may be utilized in the practice of the present invention.

According to the preferred method of the present invention, comminuted cellulosic fibrous material, e.g. paper pulp, from a source 10 (such as a digester or storage vessel) is subjected to DTPA pre-treatment in a vessel 12. DTPA, or like chelating agent, is added to pulp that has a fairly low pH. For example in the DTPA pre-treatment stage 12 the pulp can be held at about 20°–23° C. at a pH of about 7 for 30 minutes. This results in a considerable removal of metals which allows a greater degree of bleaching without viscosity loss. For example compared to feed stock not treated with the chelating agent, the viscosity is the same at two Kappa points lower.

While the consistency of the pulp may vary widely, it is desirable to perform the steps while the consistency of the pulp is maintained between about 6–15%, i.e. medium consistency. The medium consistency pulp is fed from the pre-treatment stage 12 to a conventional oxygen stage (oxygen reactor) 14 where oxygen bleaching takes place. The temperature and pressure conditions in the oxygen stage 14 are conventional (e.g. about 90° to 100° C. at substantially atmospheric pressure), and caustic, e.g. NaOH, is added to the pulp. Other pressure and temperature conditions can be utilized, but it is desirable to maintain the pressure and temperature conditions as close as feasible to conventional systems.

After bleaching in the first oxygen stage 14, the pulp is passed to a countercurrent wash stage 16 (or the washing can take place at one end of the oxygen reactor 14). While a countercurrent wash flow is preferred, a wide variety of different washes may be utilized in order to effectively remove metals or the like. In FIG. 1 the countercurrent wash liquid is shown introduced at 18 with the spent wash liquor removed at 20. Also for maximum results it is desirable to use another chelating agent, such as EDTA, in the wash liquid, as by adding it to the countercurrent flow 18 as illustrated in FIG. 1.

After the wash stage 16 the pulp, still of medium consistency, is passed to a second oxygen stage 22, substantially identical to the first stage 14. While under many circumstances exactly two bleaching stages 14, 22 will achieve the desired results, any number of bleaching stages, as indicated schematically at 24 in FIG. 1, may be provided, as long as a wash is provided between each. For example a second wash stage 26 with countercurrent wash liquor introduction at 28 and removal at 30, and third oxygen bleaching stage 32, may be utilized. After the last oxygen bleaching stage, the pulp may be washed, passed to storage, or otherwise treated depending upon the desired end use.

Figure 2:
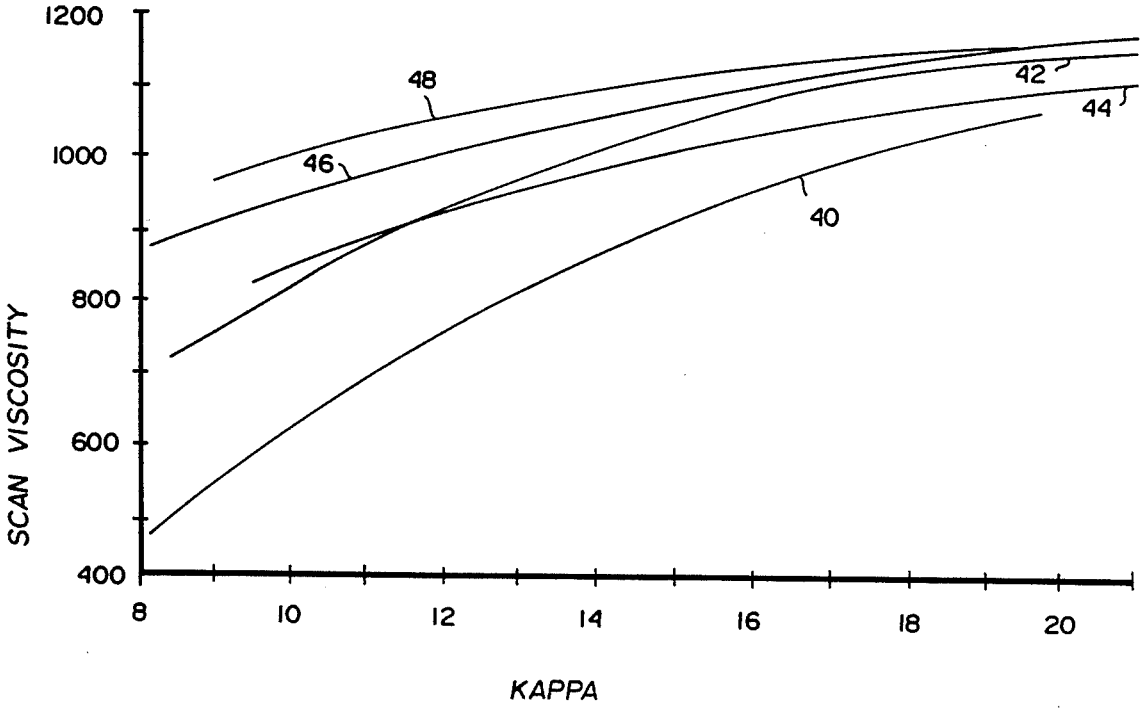
FIG. 2 is a graphical approximation of results achievable in the practice of the present invention compared to other procedures, showing the viscosity of the pulp at various Kappa numbers.

A graphical representation of the results that are achievable according to the invention is illustrated in FIG. 2. In FIG. 2 the scan viscosity has been plotted against Kappa number (i.e. strength vs. degree of bleaching). Line 40 is a rough approximation of the results achieved when there is no chelating agent used and no between stage washing during oxygen treatment. Line 42 is a rough approximation of when there is treatment with the chelating agent but no between stage washing. Line 44, which is roughly equivalent to line 42, illustrates the results when there is no chelating agent treatment but between stage washing. Line 46 illustrates the results when there is a pre-treatment with a chelating agent and between stage washing, and line 48 illustrates the results when there is pre-treatment with a chelating agent, treatment in each of the oxygen stages with chelating agent, and between stage washing (the optimum results). As FIG. 2 clearly illustrates, between stage washing very significantly increases pulp viscosity especially at lower Kappa numbers (higher degrees of bleaching).

The following tables illustrates the results achievable by practicing the invention compared to other procedures. Table 1 is an index of the different samples run in the testing set forth in Tables 2 through 8. Note that there are 13 samples.

Tables 2 shows the parameters at the various stages for each of the first 11 samples. Table 3 shows the parameters at each of the stages and the results achieved for sample 13. Table 4 illustrates the parameters between stages and the results achieved for sample 12; sample 12 is a test merely to determine whether or not there is any impact from the cooling between mixing stages of multi-stage trials. This test was run utilizing a conventional mixer, namely one sold under the trademark "MC ®" by Kamyr, Inc. of Glens Falls, N.Y. and Kamyr AB of Karlstad, Sweden. In this sample since the mixer was the reactor, oxygen and caustic are added without any cooling resulting. No significant difference in results was obtained in sample 12 compared to others, indicating that cooling between mixing stages does not play any significant role in the results achieved.

Tables 5 through 8 have self-explanatory titles. In Table 5 note that for the last sample the ph was adjusted by adding black liquor. All of the results indicate the improved results achieved according to the invention, utilizing inter-stage washing. The practice of the invention allows one to minimize the amount of chlorine added in a first chlorine stage prior to oxygen bleaching, or to eliminate chlorine bleaching all together. In all the tests, the consistency of the pulp was between about 6–15%, although the invention can be practiced utilizing pulp of other consistencies.

The between stage washing and multiple oxygen stage treatment before any chlorination reduces the pH sufficiently so as to make chelating agents effective.

While the following examples used EDTA in some circumstances and DTPA in others, it should be understood that either—or some other conventional chelating agent—may be used at any particular point in the process, the choice of agent depending upon the pH and/or other conditions at that point.

TABLE 1

| Number | Stages | Pretreatment | Wash Between Stages | EDTA In Each |
|---|---|---|---|---|
| 1 | 4 | No | Yes | No |
| 2 | 5 | DTPA | Yes | No |
| 3 | 4 | No | No | No |
| 4 | 1 | DTPA | No | No |
| 5 | 4 | DTPA | No | No |
| 6 | 1 | No | No | No |
| 7 | 1 | No | No | No |
| 8 | 1 | DTPA | No | No |
| 9 | 1 | No | No | Yes |
| 10 | 1 | DTPA | No | Yes |
| 11 | 2 | DTPA | Yes | Yes |
| 12 | 4 | DTPA | No | No(MC Mixer) |
| 13 | 5 | DTPA | Yes | Yes |

TABLE 2

Multiple and Single Stage Oxygen Delignification

Starting pulp: Hemlock
Kappa/K Number: 34.6/23.0
Viscosity: 1341 cm3/g (Scan), 55.8 cp (Tappi), 0.5% CED)
Metals, ppm:

| | |
|---|---|
| Iron, Fe | 42 |
| Copper, Cu | 53 |
| Manganese, Mn | 64 |

| Sample | 1 | 2 | 3 | 4 | 5 | 6 | 7 | 8 | 9 | 10 | 11 |
|---|---|---|---|---|---|---|---|---|---|---|---|
| DTPA Pretreatment | No | Yes | No | Yes | Yes | No | No | Yes | No | Yes | Yes |
| Interstage Wash | Yes | Yes | No | | No | | | | | | Yes |
| Stage | 1st | 1st | 1st | | 1st | | | | | | 1st |
| NaOH % on pulp | 2.0 | 2.0 | 2.0 | 4.5 | 2.0 | 4.5 | 5.2 | 6.0 | 5.2 | 6.0 | 1.5 |

TABLE 2-continued

| Multiple and Single Stage Oxygen Delignification | | | | | | | | | | | |
|---|---|---|---|---|---|---|---|---|---|---|---|
| EDTA % on pulp | — | — | — | — | — | — | — | — | 0.5 | 0.5 | 0.5 |
| Temp. °C. | 90 | 90 | 90 | *90→100 | 90 | *90→100 | *90→100 | *90→100 | *90→100 | *90→100 | 90 |
| Time, min | 60 | 60 | 60 | 30/60 | 60 | 30/60 | 30/90 | 30/90 | 30/90 | 30/90 | 60 |
| Final pH | 10.0 | 10.3 | 10.0 | 12.1 | 10.8 | 11.7 | 11.4 | 12.7 | 11.6 | 12.8 | 9.9 |
| K # | 13.9 | 13.4 | 13.9 | 7.4 | 13.0 | 7.7 | 7.2 | 6.0 | 6.7 | 6.2 | 15.6 |
| Kappa # | 20.2 | 20.2 | 19.8 | 11.3 | 20.6 | 10.7 | 9.6 | 8.4 | 9.7 | 8.8 | 23.7 |
| Kappa # reduction % | 41.6 | 41.6 | 42.8 | 67.3 | 40.5 | 69.1 | 72.3 | 75.7 | 72.0 | 74.6 | 31.5 |
| Viscosity, Scan/Tappi | 1108/31.8 | 1140/34.3 | 1098/31.0 | 922/20.3 | 1145/34.8 | 750/13.4 | 669/11.0 | 803/15.2 | 762/13.8 | 851/17.1 | 1227/42.3 |
| Yield % | 97.6 | 97.5 | — | 94.4 | — | 93.4 | 93.0 | 92.7 | 93.1 | 93.2 | 96.6 |
| Metals, ppm: | | | | | | | | | | | |
| Iron, Fe | 27 | 19 | — | | — | | 33 | 26 | 40 | 20 | 25 |
| Copper, Cu | 42 | 6.3 | — | | — | | 145 | 8.3 | 9.0 | 5.1 | 6.1 |
| Manganese, Mn | 26 | 1.3 | — | | — | | 34 | 2.5 | 2.0 | 1.0 | 0.84 |
| Stage | 2nd | 2nd | 2nd | | 2nd | | | | | | 2nd |
| NaOH % | 1.2 | 1.2 | 1.8 | | 1.2 | | | | | | 5.5 |
| Temperature °C. | 90 | 90 | 90 | | 90 | | | | | | 90/100 |
| Time, min | 60 | 60 | 60 | | 60 | | | | | | 30/90 |
| Final pH | 11.1 | 11.4 | 11.6 | | 11.4 | | | | | | 12.7 |
| K # | 11.3 | 11.2 | 9.5 | | 10.3 | | | | | | 6.0 |
| Kappa # | 16.9 | 16.5 | 14.3 | | 15.2 | | | | | | 8.8 |
| Kappa # reduction % | 16.3 | 18.3 | 27.8 | | 26.2 | | | | | | 62.9 |
| Overall reduction % | 51.2 | 52.3 | 58.7 | | 56.1 | | | | | | 74.6 |
| Viscosity, Scan/Tappi | 1012/25.2 | 1116/32.4 | 899/19.2 | | 1056/28.0 | | | | | | 904/19.4 |
| Yield/Overall yield % | 98.1/95.8 | 98.0/95.6 | — | | — | | | | | | 93.7 |
| Stage | 3rd | 3rd | 3rd | | 3rd | | | | | | |
| NaOH % | 1.8 | 1.8 | 2.0 | | 1.8 | | | | | | |
| Temperature °C. | 100 | 100 | 100 | | 100 | | | | | | |
| | 60 | 60 | 60 | | 60 | | | | | | |
| Final pH | 11.9 | 12.1 | 11.5 | | 11.6 | | | | | | |
| K # | 8.3 | 8.1 | 6.8 | | 6.9 | | | | | | |
| Kappa # | 11.9 | 12.1 | 9.8 | | 10.5 | | | | | | |
| Kappa # reduction % | 29.6 | 26.7 | 31.5 | | 30.9 | | | | | | |
| Overall reduction % | 65.6 | 65.0 | 71.7 | | 69.7 | | | | | | |
| Viscosity, Scan/Tappi | 916/20.0 | 997/24.3 | 612/9.6 | | 851/17.1 | | | | | | |
| Yield/Overall yield % | 98.6/94.4 | 98.7/94.4 | — | | — | | | | | | |
| Stage | 4th | 4th | 4th | | 4th | | | | | | |
| NaOH % | 2.0 | 2.0 | 1.8 | | 2.0 | | | | | | |
| Temperature °C. | 100 | 100 | 100 | | 100 | | | | | | |
| | 60 | 60 | 60 | | 60 | | | | | | |
| Final pH | 12.2 | 12.4 | 11.5 | | 12.3 | | | | | | |
| K # | 6.6 | 6.8 | 5.4 | | 5.8 | | | | | | |
| Kappa # | 9.5 | 9.8 | 8.0 | | 8.2 | | | | | | |
| Kappa # reduction % | 20.2 | 19.0 | 18.4 | | 21.9 | | | | | | |
| Overall reduction % | 72.5 | 71.7 | 76.9 | | 76.3 | | | | | | |
| Viscosity, Scan/Tappi | 829/16.2 | 950/21.7 | 457/6.6 | | 705/12.0 | | | | | | |
| Yield/Overall yield % | 99.0/93.5 | 99.5/93.9 | 91.8 | | 92.3 | | | | | | |
| Stage | — | 5th | — | | — | | | | | | |
| NaOH % | — | 2.5 | — | | — | | | | | | |
| Temperature °C. | — | 100 | — | | — | | | | | | |
| Final pH | — | 12.8 | — | | — | | | | | | |
| K # | — | 5.7 | — | | — | | | | | | |
| Kappa # | — | 8.0 | — | | — | | | | | | |
| Kappa # reduction % | — | 18.4 | — | | — | | | | | | |
| Overall reduction % | — | 76.9 | — | | — | | | | | | |
| Viscosity, Scan/Tappi | — | 884/18.5 | — | | — | | | | | | |
| Yield/Overall yield % | — | 98.4/92.4 | — | | — | | | | | | |
| Metals, ppm | | | | | | | | | | | |
| Fe | 29 | 32 | 33 | | 30 | | | | | | |
| Cu | 19 | 16 | 29 | | 10 | | | | | | |
| Mn | 5.4 | 7.3 | 28 | | 2.5 | | | | | | |

Conditions for all stages: 60 min. 70 psig O2 pressure, 12% Cs, 0.5% MgSO4 on pulp (but for sample #3 & #5 in first stage only)
Conditions for DTPA pretreatment: 20–23° C., pH 7, 30 minutes
DPTA:
1st treat: 0.5% on pulp
2nd treat: 0.3% on pulp
*Sample #4 & #6: 90° C., 30 minutes; 100° C., 60 minutes
Sample #7 & #8: 90° C., 30 minutes; 100° C., 90 minutes

TABLE 3

MULTIPLE AND SINGLE STAGE OXYGEN DELIGNIFICATION

Starting Pulp: Hemlock, cook No. B1372
Kappa/K No.: 34.6/23.0
Viscosity: 1341 $cm^3/g$ (SCAN), 55.8 cp (TAPPI, 0.5% CED)
Metals, ppm: Fe = 42, Cu = 53, Mn = 64

| | |
|---|---|
| Sample No. | 13 |
| DTPA Pretreatment | Yes |
| Interstage wash | Yes |
| Stage | First |
| NaOH, % on pump | 2.0 |
| EDTA, % on pulp | 0.5 |
| MgSO4, % on pulp | 0.5 |
| Temperature, °C. | 90 |
| Time, minutes | 60 |
| Final PH | 10.4 |
| K no. | 13.4 |
| Kappa No. | 19.4 |
| Kappa No. Reduction, % | 43.9 |
| Viscosity, Scan/TAPPI | 1138/34.2 |
| Yield, % | 97.1 |
| Metals, ppm: | |
| Iron, Fe | 23 |
| Copper, Cu | 5.2 |
| Manganese, Mn | 0.75 |
| Stage | Second |
| NaOH, % | 1.2 |
| EDTA, % on pulp | 0.5 |
| MgSO4, % on pulp | 0.5 |
| Temperature, °C. | 90 |
| Time, minutes | 60 |
| Final PH | 11.3 |
| K No. | 11.3 |
| Kappa No. | 16.3 |
| Kappa No. reduction, % | 16.0 |
| Overall reduction, % | 52.9 |
| Viscosity, Scan/TAPPI | 1116/32.4 |
| Yield/overall yield, % | 98.7/95.8 |
| Stage | Third |
| NaOH, % | 0.4 |
| EDTA, % on pulp | 0.5 |
| MgSO4, % on pulp· | 0.5 |
| Temperature | 100 |
| Time, minutes | 60 |
| Final PH | 9.5 |
| K No. | 10.5 |
| Kappa No. | 15.2 |
| Kappa No. reduction, % | 6.8 |
| Overall reduction, % | 56.1 |
| Viscosity, Scan/TAPPI | 1112/32.1 |
| Yield/overall yield, % | 99.7/95.5 |
| Stage | Fourth |
| NaOH, % | 2.0 |
| EDTA, % on pump | 0.5 |
| MgSO4, % on pulp | 0.5 |
| Temperature, °C. | 100 |
| Time, minutes | 60 |
| Final PH | 12.5 |
| K No. | 8.0 |
| Kappa No. | 11.2 |
| Kappa No. reduction, % | 26.3 |
| Overall reduction, % | 67.6 |
| Viscosity, Scan/TAPPI | 1033/26.5 |
| Yield/overall yield, % | 99.2/94.7 |
| Stage | Fifth |
| NaOH, % | 2.5 |
| EDTA, % on pulp | 0.5 |
| MgSO4, % on pulp | 0.5 |
| Temperature, °C. | 100 |
| Time, minutes | 60 |
| Final PH | 12.7 |
| K No. | 6.1 |
| Kappa No. | 9.0 |
| Kappa No. reduction. % | 19.6 |
| Overall reduction, % | 74.0 |
| Viscosity, Scan/TAPPI | 981/23.4 |
| Yield/overall yield, % | 98.3/93.1 |
| Metals (ppm): | |
| Fe | |
| Cu | |
| Mn | |

TABLE 3-continued

MULTIPLE AND SINGLE STAGE OXYGEN DELIGNIFICATION

Conditions for all stages: 60 min. 70 psig 02 pressure, 12% Cs.
Conditions for DTPA pretreatment: 20–23° C., PH 7, 30 min.
DPTA:
First treat.: 0.5% on pulp
Second treat.: 0.3% on pulp

TABLE 4

Starting Pulp: Hemlock, Cook No. 81372
Kappa/K No.: 34.6/23.0
Viscosity: 1341 cm3/g (SCAN), 55.8 cp (Tappi, 0.5% CED)
Metals, ppm:

| | |
|---|---|
| Iron, Fe | 42 |
| Copper, Cu | 53 |
| Manganese, Mn | 64 |

| | |
|---|---|
| Sample No. | 12 |
| DTPA Pretreatment | Yes |
| Interstage Wash | No |
| First Addition (1st stage) | |
| NaOH, % on OD pulp | 2.0 |
| MgSO4, % on pulp | 0.5 |
| Temperature, °C. | 90 |
| Consistency, % | 10.0 |
| Second Addition (2nd stage) | |
| NaOH, % on 1st stage raw pulp | 1.0 |
| Temperature, °C. | 90 |
| Consistency, % | 9.9 |
| Third Addition (3rd stage) | |
| NaOH, % on 1st stage raw pulp | 1.5 |
| Temperature, °C. | 100 |
| Consistency, % | 9.8 |
| Fourth Addition (4th stage) | |
| NaOH, % on 1st stage raw pulp | 2.0 |
| Temperature, °C. | 100 |
| Consistency, % | 9.7 |
| Final pH | 12.3 |
| K No. | 5.8 |
| Kappa No. | 9.1 |
| Kappa No. reduction, % | 73.7 |
| Viscosity, Scan/Tappi | 797/15.0 |
| Yield, % | 91.0 |
| Metals (ppm): | |
| Iron, Fe | |
| Copper, Cu | |
| Maganese, Mn | |

Conditions for all stages: 60 min. 70 psig 02 pressure, 12% Cs, no sampling between stages
Fluidizing speed: From 0 to 2100 rpm in minimum time (about 5") right after chemical addition in each stage
Mixing speed: 400 rpm about 1 second in every 10 minutes
Cond. for DTPA pretreatment 20–23° C., pH 7, 30 min.
DTPA:
1st treat: 0.5% on pulp
2nd treat: 0.3 on pulp

TABLE 5

CHELATING AGENT TREATMENT
Raw Pulp: Lab cook soft Kraft pulp, Cook No.: B1372

| Sample No. | Chelating Agent | Agent % on Pulp | Adjusted Init. pH | Final pH | Metals Fe | Cu | Mn |
|---|---|---|---|---|---|---|---|
| Raw Pulp | — | — | — | — | 42 | 53 | 54 |
| T-1 | DPTA | 0.5 | 7.0 | 8.2 | 26 | 7.0 | 3.1 |
| T-2 | EDTA | 0.5 | 7.0 | 7.2 | 20 | 3.9 | 1.6 |
| T-3 | EDTA | 0.5 | 10.0 | 9.4 | 27 | 44 | 7.5 |
| T-4 | EDTA | 0.5 | 12.1 | 11.5 | 23 | 39 | 11 |

TABLE 5-continued

CHELATING AGENT TREATMENT
Raw Pulp: Lab cook soft Kraft pulp, Cook No.: B1372

| Sample No. | Chelating Agent | Agent % on Pulp | Adjusted Init. pH | Final pH | Metals Fe | Cu | Mn |
|---|---|---|---|---|---|---|---|
| T-5* | EDTA | 0.5 | 10.0 | 9.3 | 27 | 47 | 4.0 |

Note:
Treatment condition: 10% Cs, 90° C., 10 min. The pulp slurry was adjusted to required pH value at room temp. Then, the chelating agent was added to the slurry and pH was readjusted to required value. After that, slurry was preheated in microwave oven to 90° C. bath for 10 min.
*Black liquor was used to adjust pH.

TABLE 6

EFFECTS OF PRETREATMENT AND INERSTAGE WASHING ON PULP METAL ANALYSIS AND VISCOSITIES

| | DPTA Pretreatment | | | | | No DPTA Pretreatment | | | |
|---|---|---|---|---|---|---|---|---|---|
| | Sample | | | | | | | | |
| | Start | #2 | #8 | #2 | #5 | #1 | #7 | #3 | #1 |
| | O2 Stages | | | | | | | | |
| | 0 | 1 | 1 | 5 | 4 | 1 | 1 | 4 | 4 |
| | Wash | | | | | | | | |
| | Yes | Yes | Yes | Yes | No | Yes | Yes | No | Yes |
| Iron, Fe, ppm | 42 | 19 | 26 | 32 | 30 | 27 | 33 | 33 | 29 |
| Copper, Cu, ppm | 53 | 6.3 | 8.3 | 16 | 10 | 42 | 42 | 29 | 19 |
| Manganese, Mn, ppm | 64 | 1.3 | 2.5 | 7.3 | 2.5 | 26 | 34 | 28 | 5.4 |
| Cu + Mn, ppm | 117 | 7.6 | 10.8 | 23.3 | 12.5 | 68 | 76 | 57 | 24.4 |
| Viscosity @ 10 kappa | | | 19 | 22 | 16.3 | | 11.5 | 10 | 17 |
| Viscosity @ 20 kappa | | 34.1 | | 34.1 | | 31.6 | | 31.2 | |

TABLE 7

VISCOSITY AT 9 KAPPA AND METALS FOR MULTI-STAGE OXYGEN DELIGNIFICATION

| Sample | DPTA Pretreat | # of Stages | Interstage Wash | EDTA in 02 Stage | TAPPI Viscosity @ 9 Kappa | Final Pulp Fe | Cu | Mn |
|---|---|---|---|---|---|---|---|---|
| 2 | Yes | 5 | Yes | No | 20 | 30 | 16 | 7.3 |
| | | | | | | 19* | 6* | 1* |
| 11 | Yes | 2 | Yes | Yes | 19.6 | 25* | 6* | 0.8* |
| 10 | Yes | 1 | | Yes | 17.3 | 20 | 5 | 1 |
| 8 | Yes | 1 | | No | 16.2 | 26 | 8 | 2.5 |
| 1 | No | 4 | Yes | No | 15.5 | 29 | 19 | 5.4 |
| | | | | | | 27* | 42* | 26* |
| 12 | Yes | 4 | No | No | 15 | 24 | 9 | 19 |
| 5 | Yes | 4 | No | No | 14 | 30 | 10 | 2.5 |
| 9 | No | 1 | | Yes | 12 | 49 | 9 | 2 |
| 7 | No | 1 | | No | 10 | 33 | (29) | 34 |
| 3 | No | 4 | No | No | 8 | 32 | 29 | 28 |

*metals after stage 1

TABLE 8

MILL MEASUREMENTS

| Location | pH | % Solids | Conductivity |
|---|---|---|---|
| BSW Feed Pulp Filtrate | 11.7 | 11.88 | 34025 |
| BSW 1st Stage Extraction | 11.17 | 9.28 | 31894 |
| BSW 1st Stage Wash | 10.25 | 5.5* | 24913 |
| BSW 2nd Stage Extraction | 10.25 | 5.68* | 24822 |
| BSW Discharge Pulp | 9.64 | 4.12 | 21177 |
| BSW 2nd Stage Wash | 9.21 | 4.06 | 19342 |
| Cylinder Mould Filtrate Tank | 9.27 | | 17325 |
| O2 Stage Exit | 8.55 | | |

It will thus be seen that according to the present invention a method for bleaching paper pulp, and a high viscosity bleached paper pulp resulting from the method, are provided which allow minimization or elimination of chlorine during bleaching by using multiple oxygen bleaching stages with washing between stages. While the invention has been herein shown and described in what is presently conceived to be the most practical and preferred embodiment thereof it will be apparent to those of ordinary skill in the art that many modifications may be made thereof within the scope of the invention, which scope is to be accorded the broadset interpretation of the appended claims so as to encompass all equivalent methods and products.

What is claimed is:

1. A method of oxgyen delignifying paper pulp comprising the steps of:

(a) effecting oxygen delignification of the pulp to a given degree of delignification in at least two consecutive stages for a time of at least about 30 minutes each; and (b) effecting washing of the pulp betwen each of said at least two consecutive stages under conditions to maximize viscosity for a given degree of delignification.

2. A method as recited in claim 1 comprising the further step (c), before step (a), of pretreating the pulp with a chelating agent.

3. A method as recited in claim 2 wherein step (c) is practiced by pretreating the pulp with one of EDTA or DTPA.

4. A method as recited in claim 2 comprising the further step (d), during the practice of step (b), of simultaneously treating the pulp with a chelating agent.

5. A method as recited in claim 4 wherein step (d) is practiced by adding one of DTPA or EDTA to the wash liquid.

6. A method as recited in claim 5 wherein step (b) is practiced by effecting a countercurrent flow of wash liquid to the pulp.

7. A method as recited in claim 1 comprising the further step of treating the pulp with additional bleaching agents besides oxygen.

8. A method as recited in claim 1 during the practice of step (b), of simultaneously treating the pulp with a chelating agent.

9. A method as recited in claim 8 wherein treating with chelating agent is practiced by adding EDTA or DTPA to the wash liquid.

10. A method as recited in claim 9 wherein step (b) is practiced by effecting a countercourrent flow of wash liquid to the pulp.

11. A method as recited in claim 9 wherein step (a) is practiced to control the pH between stages so that it is at an acidic level conducive to effective EDTA or DTPA chelating.

12. A method as recited in claim 1 wherein step (a) is practiced so that there are more than two consecutive oxygen delignification stages, each for a time period of at least about 30 minutes.

13. A method of delignifying a suspension of comminuted cellulosic fibrous material at a consistency of about 6–15% to a given degree of delignification, comprising the steps of sequentially, consecutively, and continuously:

(a) subjecting the suspension, while at a consistency of about 6–15%, to a first oxygen delignification treatment for a time of at least about 30 minutes;

(b) washing the suspension, while at a consistency of about 6–15%, under conditions to maximize viscosity; and (c) subjecting the suspension, while at a consistency of about 6–15%, to a second oxygen delignification treatment for a time of at least about 30 minutes to the given degree of delignification.

14. A method as recited in claim 13 wherein step (b) is practiced by a countercurrent flow of wash liquid.

15. A method as recited in claim 14 comprising the further step, during the practice of step (b), of adding a chelating agent to the wash liquid.

16. A method as recited in claim 13 comprising the further step, prior to step (a), of pretreating the suspension with a chelating agent.

17. A method of oxygen delignifying paper pulp to a given degree of delignificantion by consecutively (a1) effecting oxygen delignification in a first stage for a time of at least about 30 minutes to allow significant kappa number reduction to occur, then immediately (a2) effecting washing of the pulp to remove undesired production of reaction, under conditions to maximize viscosity and then immediately (a3) effecting oxygen delignification in a second stage for a time period of at least about 30 minutes, to the given degree of delignification.

18. A method as recited on claim 17 wherein step (a1) is practiced to reduce the kappa number in the first stage of oxygen delignification by at least about 40%.

19. A method as recited in claim 17 comprising the further step of treating the pulp with a chelating agent.

20. A method as recited in claim 17 comprising the further step of practicing at least one more oxygen delignification stage with washing between the consecutive oxygen delignifiation stages.

* * * * *